US009833119B2

(12) United States Patent
Thomas

(10) Patent No.: US 9,833,119 B2
(45) Date of Patent: Dec. 5, 2017

(54) DUAL SIDED REUSABLE FLOOR-CLEANING CLOTH

(71) Applicant: Shelley Angela Thomas, New Orleans, LA (US)

(72) Inventor: Shelley Angela Thomas, New Orleans, LA (US)

( * ) Notice: Subject to any disclaimer, the term of this patent is extended or adjusted under 35 U.S.C. 154(b) by 0 days.

(21) Appl. No.: 15/256,994

(22) Filed: Sep. 6, 2016

(65) Prior Publication Data

US 2017/0086639 A1 Mar. 30, 2017

Related U.S. Application Data

(60) Provisional application No. 62/234,259, filed on Sep. 29, 2015.

(51) Int. Cl.

| | |
|---|---|
| ***A47L 13/16*** | (2006.01) |
| ***A47L 13/44*** | (2006.01) |
| ***A47L 13/256*** | (2006.01) |

(52) U.S. Cl.
CPC ..... *A47L 13/44* (2013.01); *A47L 13/16* (2013.01); *A47L 13/256* (2013.01)

(58) Field of Classification Search
CPC ..... A47L 13/44; A47L 13/16; A47L 13/256
See application file for complete search history.

(56) References Cited

U.S. PATENT DOCUMENTS

| | | | | |
|---|---|---|---|---|
| 6,745,434 | B2 * | 6/2004 | Smith | A47L 13/44 15/104.94 |
| 7,404,227 | B2 * | 7/2008 | Otsuka | A47L 13/20 15/208 |
| 7,553,783 | B2 * | 6/2009 | Tanaka | A47L 13/20 15/118 |
| 2006/0270586 | A1 * | 11/2006 | Jordan, IV | A47L 13/17 510/439 |

* cited by examiner

*Primary Examiner* — Shay Karls

(57) ABSTRACT

A dual sided reusable floor-cleaning cloth having outer layers which are preferably made of woven material which can be fastened by Velcro or the like without limitation, thereby combining the cloth and rod handle into a set. The cleaning cloth is dual sided providing additional benefits such as increasing durable use of the cloth.

1 Claim, 3 Drawing Sheets

DUAL SIDED REUSABLE FLOOR-CLEANING CLOTH

CROSS-REFERENCE TO RELATED APPLICATION

The present application is based on, and claims the benefit of priority of U.S. application Ser. No. 62/234,259, filed on Sep. 29, 2015, the disclosure of which is hereby incorporated by reference herein in its entirety.

BACKGROUND OF THE INVENTION

1. Field of the invention

The field of the invention is dual sided floor-cleaning cloth that can be reusable for both wet and dry cleaning purpose on the same device.

2. Description of the Prior Art

Cleaning cloth has widespread usage by being manually held and manipulated in the cleaning operation. Cleaning cloth has also been used by being secured to some type of implement, such as a broom or mop.

Mopping devices for mopping surfaces to be cleaned are widely known and in extensive use in professional and non-professional floor cleaning. They use a mop holder with a removably attached flat cleaning cloth from textile material made from natural or synthetic fibers including and increasingly using micro-fibers.

Presently, the cleaning sheet that is currently used for a certain floor device is a cleaning sheet that is inserted in slits on the floor device. This method does not allow for a secure fit on the cleaning device allowing the cloth to constantly come apart from the mop head. The only cleaning sheet available for use with several floor cleaning devices (such as a swifter) is a disposable sheet.

Flat cleaning cloth, as well, are widely known for use in mopping devices for mopping surfaces to be cleaned. A typical flat cleaning cloth has a flat backing textile made of cotton, polyester, or polyamide, onto which loops and/or fringes are attached as a trimming. Reference is made to a prior art of U.S. Pat. No. 5,887,311 A, which extensively explains the materials used, including microfibers for trimmings or the like.

Cleaning of vertically oriented baseboards or the like is improved by the use of a backing textile that extends, at least toward the longitudinal edges thereof, past the edges defined by the outer contour of the mop holder to form a relatively broad edge strip on each longitudinal side of the cleaning cloth (DE 31 39 245 C2). Those broad edge strips may be easily folded and may glide without problems, so that vertical surfaces like baseboards can be cleaned by just sweeping past with the mopping device.

The attachment means for the mop holder are usually positioned near the transversal edges of the cleaning cloth, but may be placed along the longitudinal edges thereof, as well. The attachment means are described as insertion pockets or holding strips. Velcro means (burr means) or other attachment means, such as clamping means, can be used, as well, and are known from the prior art (U.S. Pat. No. 5,887,311 U1; DE 94 02509 U1; WO 03/020100 A1).

A cleaning cloth may encounter problems of falling out when attached to a mop holder during floor cleaning. In order to increase the positioning stability of the cleaning cloth on the mop holder, it may be helpful to provide that the backing textile on its top side is provided with attachment means approximately where the longitudinal edges of a mop holder rest on the backing textile when such mop holder is in place on the cleaning cloth.

However, as already explained above, it may also be helpful to use insertion pockets or holding strips on the longitudinal edges of the cleaning cloth instead of the transversal edges and using a mop holder with a longitudinally-extending folding axis instead of the usual transversal folding axis.

A need exists in the current art for a cleaning cloth having holding strips on the longitudinal edges of the cleaning cloth instead of the transversal edges and using a mop holder with a longitudinally-extending folding axis instead of the usual transversal folding axis. It is to this need that the present invention is directed that the present invention solves the problem by a unique set of elements described according to the following claims.

SUMMARY OF THE INVENTION

An object of this invention is to provide a dual sided reusable cleaning cloth which can be economically made with enhanced cleaning ability.

At present, the cleaning cloth according to the invention has been described with the fastening means on top of the backing textile. Nevertheless, it is a possible option that an additional backing layer is positioned on the top side of the backing textile and fixedly attached thereto, and carries the fastening means for attaching the cleaning cloth to the mop holder.

According to an embodiment of the present invention, the cleaning efficiency of the flat cleaning cloth according to the invention may be considerably improved in that a second mopping side of the cleaning cloth having a backing textile with fastening means on the top side is provided. The backing textiles of both mopping sides are separate parts, but fixedly connected to each other, or are formed as a unitary enlarged backing textile.

In the present cleaning cloth, it is possible and preferable that the backing textile, at least on the mopping side, is provided with a trimming of natural or, preferably, synthetic fibers. In particular, the trimming is of loop-forming material such as terrycloth or of cut, densely positioned fibers such as velvet. A trimming of densely positioned fibers or of densely positioned loop-like material is particularly convenient to manufacture with a knitted fabric as backing textile. This is particularly true if the backing textile as a whole, or at least a trimming of the backing textile, is made of micro-fiber material. Polyester is a particularly convenient fiber material, especially for micro-fibers.

The object of the present invention is to improve the function of a cleaning cloth made for floor cleaning devices. This invention is a reusable cleaning cloth providing an environmentally green sustainability. This invention can provide wet and dry cleaning on the same device. By using the disposable cleaning sheet provided for a floor cleaning device, a separate floor cleaning device is needed for wet or dry cleaning. This invention can provide wet or dry cleaning on the same floor cleaning device instead of needing separate floor cleaning devices.

In another embodiment of the present invention, the fastening means may comprise adhesive elements or snap elements suitable fixing to the backing textile and be selected from a group consisting of VELCRO, adhesive, snaps, or any combination thereof.

DETAILED DESCRIPTION OF THE INVENTION

Figure 1:
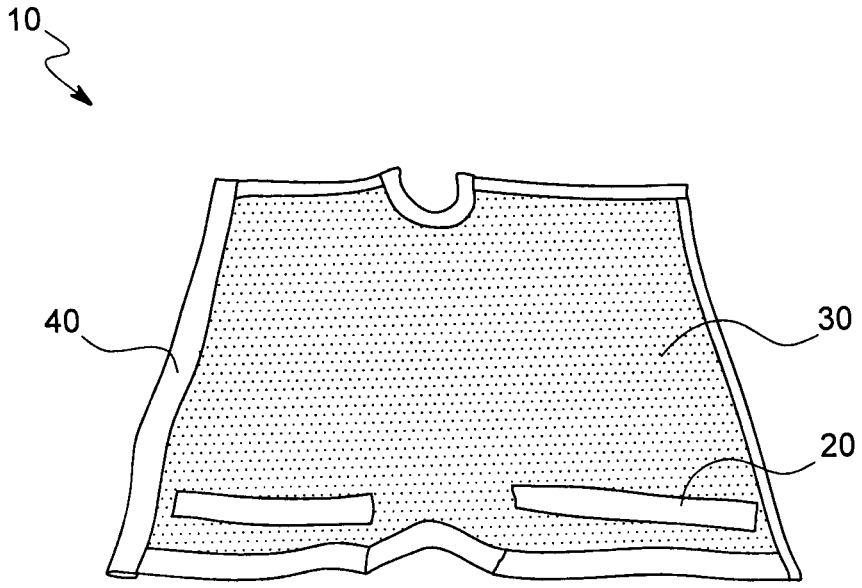
FIG. 1 shows the cleaning cloth by itself, seen from the top.
Figure 3:
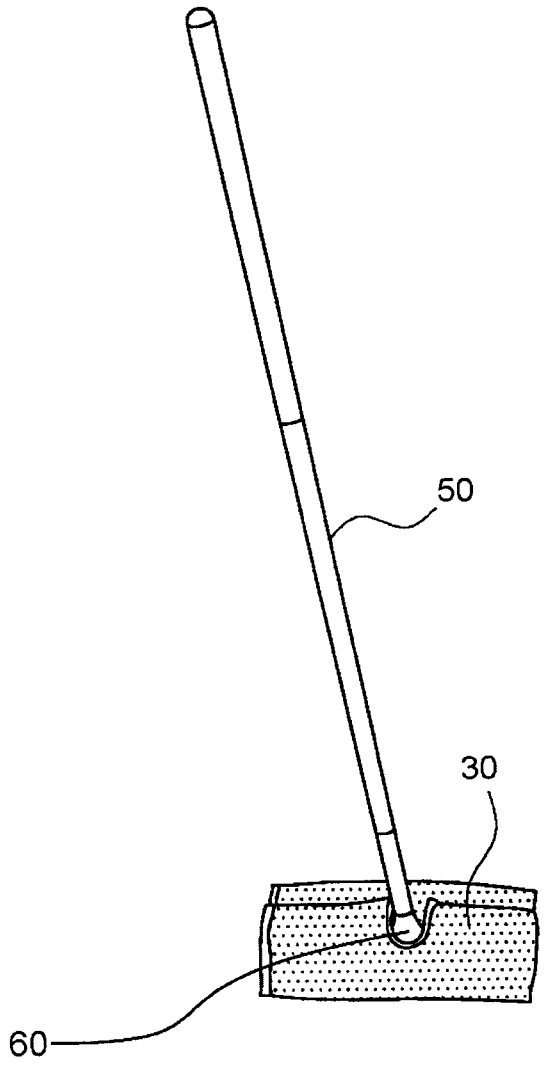
FIG. 3 shows the cleaning cloth fastened on a mop holder in a top view.

FIG. 1 primarily shows the top side of the cleaning cloth 10 comprising a large area of backing textile having longitudinal edges 40, as well as a mopping side 30, which is active in cleaning shown in FIG. 3 used to secure the cleaning cloth onto a plate-like mop holder 60 of a mopping device 50.

Figure 2:
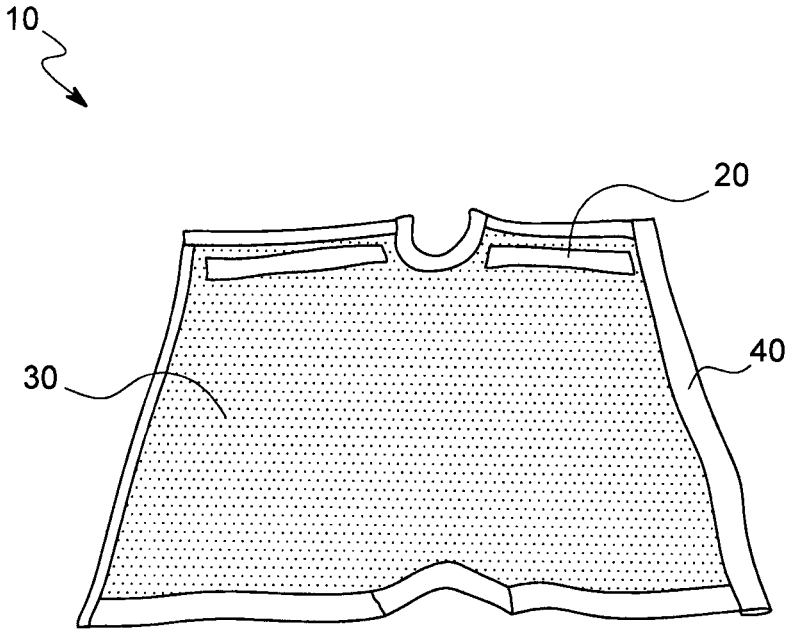
FIG. 2 shows the cleaning cloth of FIG. 1 by itself, seen from the bottom.

FIG. 2 is the view from the bottom side of the cleaning cloth 10 having a mopping side 30 running through the backing textile and fastening means 20 to secure the cleaning cloth 10 to the mop holder 60 as shown in FIG. 3. In this embodiment, the backing textile is made of the same material. This is particularly polyester material here as well, which may then expediently also be sewn using polyester thread.

FIG. 3 illustrates the mop holder 60 implemented as a plate for the cleaning cloth to be held on the mop holder 60. It is correspondingly true here that even for a mop holder 60 whose width is reduced at the end, a corresponding application of the teaching of the present patent application is possible. In addition, the cleaning cloth 10 holding onto the mop holder 60 is also correspondingly applicable for fastening means for VELCRO means or the like.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

Having illustrated and described the principles of the present invention in a preferred embodiment, it will be apparent to those skilled in the art that the embodiment can be modified in arrangement and detail without departing from such principles. Any and all such embodiments are intended to be included within the scope of the following claims.

What is claimed is:

1. A dual sided reusable floor cleaning cloth for wet and dry cleaning, comprising:

a rectangular sheet, consisting of a single layer made of a natural material, the single layer comprises a front cleaning surface, a back cleaning surface opposite the front cleaning surface, a first side edge and a second side edge opposite the first side edge, a first securing member comprising a first fastener that extends along the first side edge on the front cleaning surface;

a second securing member comprising a second fastener that extends along the second side edge on the back cleaning surface; wherein, the first and second fasteners are selected from a group consisting of VELCRO, adhesive, snaps, ties and any combination thereof, and the cleaning sheet is reversible to allow the front and back cleaning surfaces to be used for wet or dry cleaning; wherein the cleaning cloth is folded around a mop holder with either the front or back cleaning surface exposed and the first fastener on the front cleaning surface is secured to the second fastener on the back cleaning surface.

* * * * *